US007033208B1

(12) United States Patent
Huang et al.

(10) Patent No.: US 7,033,208 B1
(45) Date of Patent: Apr. 25, 2006

(54) FLEXIBLE PRINTED CIRCUIT CONNECTOR

(75) Inventors: Chung Hsin Huang, Tucheng (TW); Yi Chiu Kao, Tucheng (TW); Yung Chi Peng, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/072,523

(22) Filed: Mar. 7, 2005

(51) Int. Cl.
*H01R 12/24* (2006.01)

(52) U.S. Cl. ..... 439/498; 439/499

(58) Field of Classification Search ..... 439/66, 439/67, 492–495, 497–499
See application file for complete search history.

(56) References Cited

U.S. PATENT DOCUMENTS 3,189,863 A * 6/1965 Leach ..... 439/418
3,307,139 A * 2/1967 Prise ..... 439/495
3,355,699 A * 11/1967 Oshva ..... 439/412
3,613,049 A * 10/1971 Niedzwiecki ..... 439/329
3,721,940 A * 3/1973 Michel et al. ..... 439/495
4,012,093 A * 3/1977 Crane ..... 439/67
5,482,473 A * 1/1996 Lord et al. ..... 439/67
5,484,295 A * 1/1996 Mowry et al. ..... 439/66
6,368,117 B1 * 4/2002 Taylor ..... 439/67
6,425,768 B1 * 7/2002 Taylor ..... 439/67
6,859,370 B1 * 2/2005 Hsu et al. ..... 361/752

* cited by examiner

*Primary Examiner*—Ross Gushi
(74) *Attorney, Agent, or Firm*—Rosenberg, Klein & Lee

(57) ABSTRACT

A flexible printed circuit connector includes a housing with contact chambers for receiving a plurality of contacts. The housing sets engagement recesses, first sliding grooves and protrusions on both side surfaces thereof. A bottom cover is mounted on the housing at the underside thereof to define a first receiving space for receiving a first flexible printed circuit. A top cover is mounted on the housing on the top thereof to define a second receiving space for containing a second flexible printed circuit. The top cover is engaged with the bottom cover to retain the two flexible printed circuits reliably and precisely.

14 Claims, 9 Drawing Sheets

FLEXIBLE PRINTED CIRCUIT CONNECTOR

BACKGROUND OF THE INVENTION

1. Field of the Invention

The present invention relates to a connector for flexible printed circuits, especially to a flexible printed circuit connector for easy assembling flexible printed circuits thereto and retaining the flexible printed circuits reliably and precisely.

2. The Related Art

Flexible printed circuit (FPC) is high resilient and lightweight, so that it is widely used in electrical devices. A FPC connector is used to electrically connect a FPC to another FPC, or a rigid printed circuit, or other electrical components. One such conventional FPC connector, as shown in FIG. 11, is provided for permanent connecting a first FPC on one end thereof and provides a receiving slot on the other end thereof to receive a second FPC. The permanent connecting of the first FPC to the conventional FPC connector is performed by Surface Mounting Technology (SMT). It is well known that the SMT procedure is complicated and the conditions for the operation of SMT are too strict, thereby creating the problem that it is troublesome to assemble the first FPC to the conventional FPC connector.

On the other hand, when the second FPC is received in the receiving slot, the FPC connector provides conventional engagement means to secure the second FPC. However, conventional engagement means usually cannot provide enough force to retain the second FPC. Furthermore, the conventional connector has no anchoring mechanism to locate the second FPC, so that the second FPC can not be ensured to be precisely and reliably retained in the conventional connector, which may result in a bad electric effect.

SUMMARY OF THE INVENTION

An object of the present invention is to provide a flexible printed circuit (FPC) connector for easy assembling flexible printed circuits thereto and reliably retaining the flexible printed circuits therein.

Another object of the present invention is to provide a FPC connector for precisely retaining a first FPC therein.

A further object of the present invention is to provide a FPC connector for precisely retaining a second FPC therein.

According to one aspect of the invention, the flexible printed circuit connector includes a dielectric housing having a plurality of contact chambers extending through the dielectric housing. A bottom cover is mounted on a bottom side of the dielectric housing to define a first receiving space therebetween for receiving a first flexible printed circuit. A top cover is mounted on a top side of the dielectric housing to define a second receiving space therebetween for receiving a second flexible printed circuit. A plurality of electrical contacts is received in the respective contact chambers. Each electrical contact has a pair of contact portions, one of which is exposed in the first receiving space to electrically connect the first flexible printed circuit, and the other of which is exposed in the second receiving space to electrically connect the second flexible printed circuit.

According to another aspect of the present invention, the flexible printed circuit connector includes a dielectric housing having a plurality of electrical contacts secured therein and exposed on an upper side and a lower side thereof. A bottom cover is mounted on a bottom side of the dielectric housing to define a first receiving space therebetween to retain and electrically connect a first flexible printed circuit. A top cover is pivotally mounted on a top side of the dielectric housing for pivotal movement between an open position to enable a second flexible printed circuit to be positioned between the dielectric housing and the top cover and a closed position with the second flexible printed circuit in electrical engagement with the electrical contacts whereafter the top cover is slidable along the dielectric housing to a latched position. The flexible printed circuit connector further includes latch means on the top cover, the bottom cover and the dielectric housing for latching the top cover in a closed and latched position.

A projection is extended downwardly from the front of the dielectric housing. The bottom cover provides an indentation to accommodate the projection, thus the front end of the first receiving space is at least partially enclosed. When the first flexible printed circuit is inserted into the first receiving space, the front end of the first flexible printed circuit is stopped by the projection thereby positioning the first flexible printed circuit in the flexible printed circuit connector.

A pair posts is formed on the top surface of the dielectric housing extending upwardly into the second receiving space. When the second flexible printed circuit is inserted into the second receiving space, the posts come into positioning holes of the second flexible printed circuit to anchor the second flexible printed circuit, thereby reliably and precisely retaining the second flexible printed circuit in the flexible printed circuit connector.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in greater detail to the preferred embodiment of the present invention.

Figure 1:
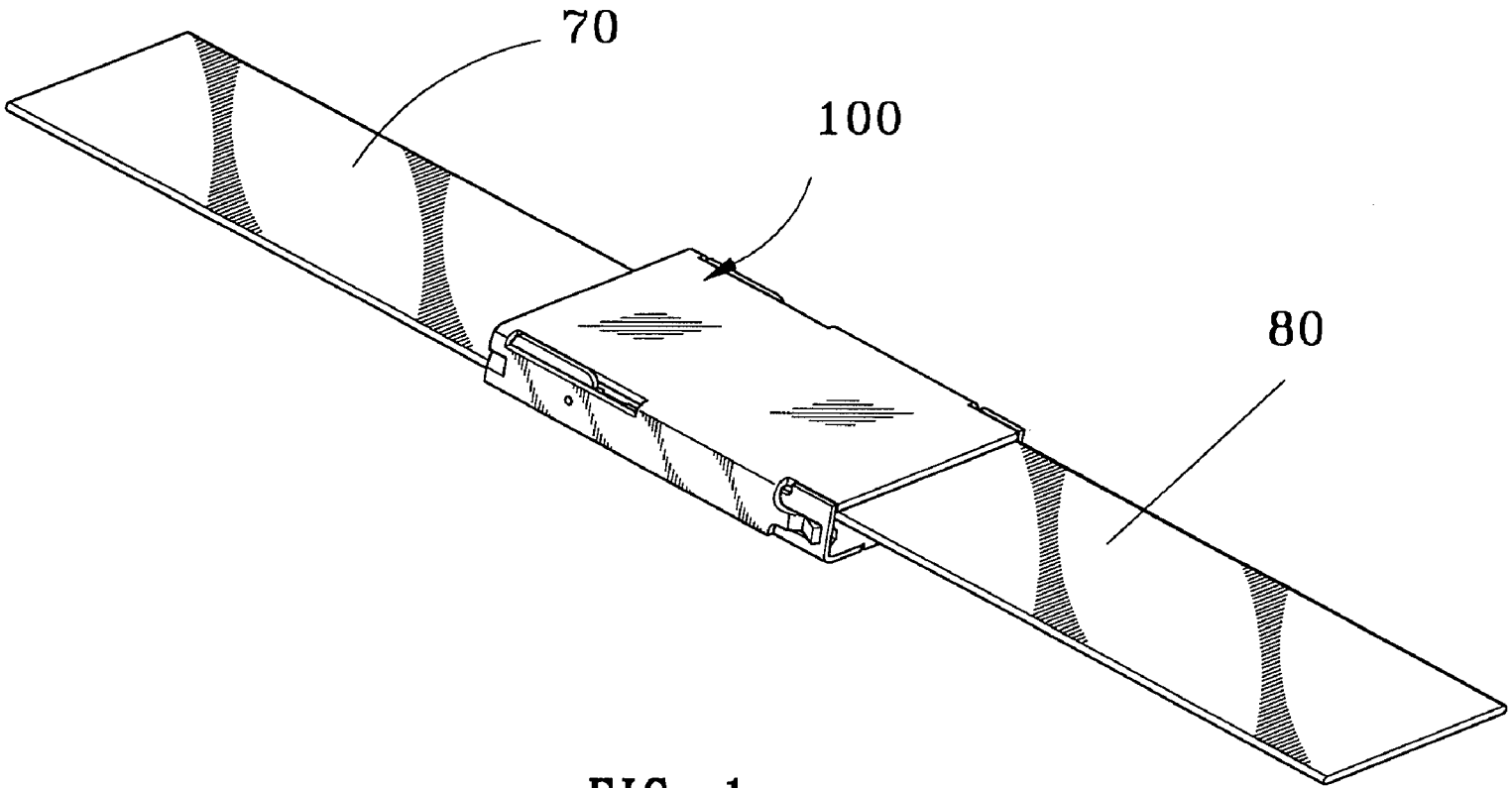
FIG. 1 is an assembled perspective view of a FPC connector according to the present invention with a first flexible printed circuit and a second flexible printed circuit inserted therein.
Figure 2:
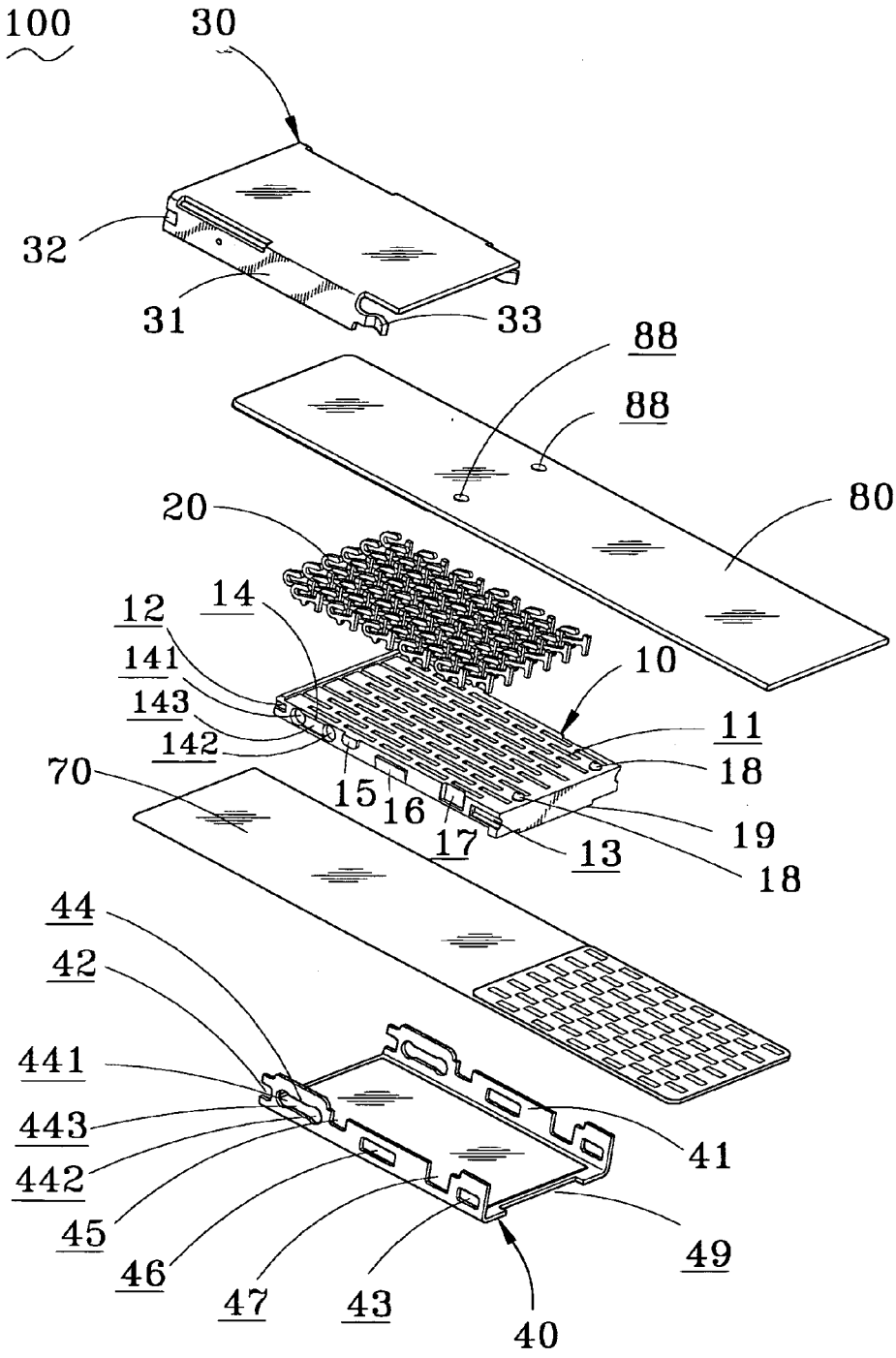
FIG. 2 is an exploded perspective view of the FPC connector shown in FIG. 1 with the first flexible printed circuit and the second flexible printed circuit also separated therefrom.
Figure 6:
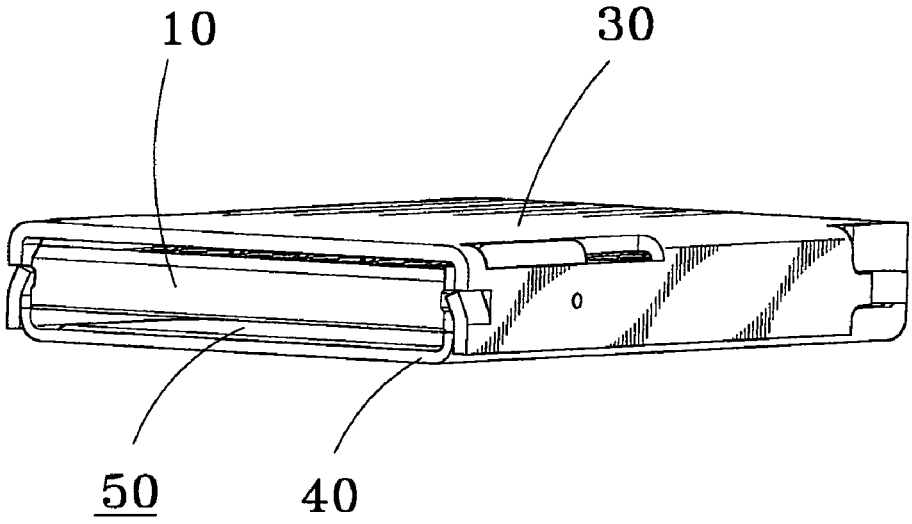
FIG. 6 is an assembled perspective view of the FPC connector seen from back.
Figure 7:
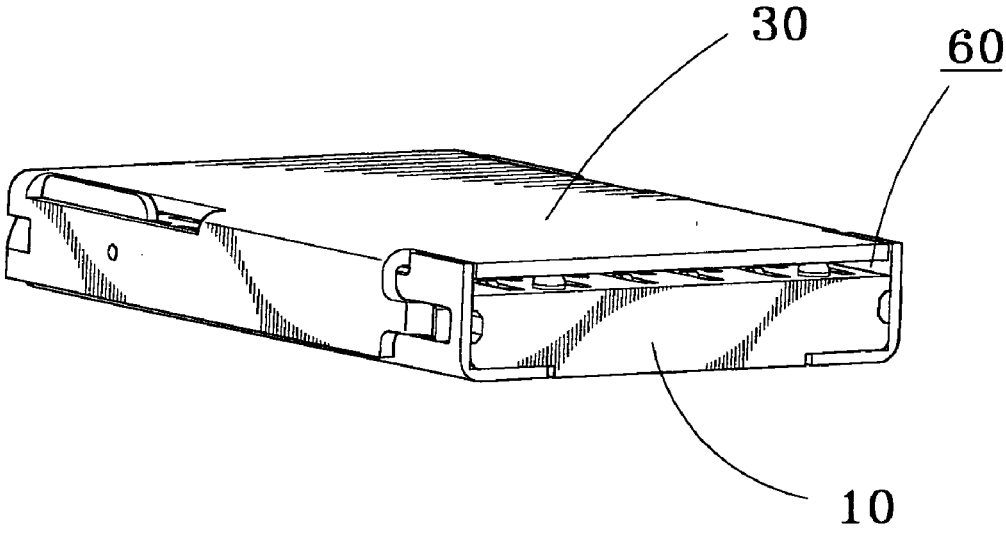
FIG. 7 is another assembled perspective view of the FPC connector seen from front.

Referring to FIGS. 1 and 2, a FPC connector 100 according to the present invention comprises a dielectric housing 10, a plurality of contacts 20 contained in the dielectric housing 10, a top cover 30 and a bottom cover 40. The bottom cover 40, as shown in FIG. 6, is mounted on a bottom side of the dielectric housing 10 to define a first receiving space 50 therebetween for accommodating a first flexible printed circuit 70. The top cover 30, as shown in FIG. 7, is mounted on a top side of the dielectric housing 10 to define a second receiving space 60 therebetween for accommodating a second flexible printed circuit 80.

With reference to FIG. 2, the dielectric housing 10 has a plurality of contact chambers 11 for receiving respective contacts 20. Each contact chamber 11 extends through the dielectric housing 10 so that the contact chamber 11 is open to a top surface and a bottom surface opposite to the top surface. A first engagement recess 12 and a second engagement recess 13 are defined in opposite side surfaces of the dielectric housing 10 and at opposite ends of the side surfaces. An upper protrusion 15 and a middle protrusion 16 are protruded outwardly from about a middle portion of each of the side surfaces. A first sliding groove 14 is defined in each side surface at the back end thereof and is adjacent to the first engagement recess 12. Each first sliding groove 14 includes a first accommodating space 141 and a second accommodating space 142 at opposite ends thereof, and a middle passage 143 extending between the first accommodating space 141 and the second accommodating space 142. The first engagement recess 12, the second engagement recess 13, the upper protrusion 15, the middle protrusion 16 and the first sliding groove 14 together constitute latch means of the dielectric housing 10.

Figure 4:
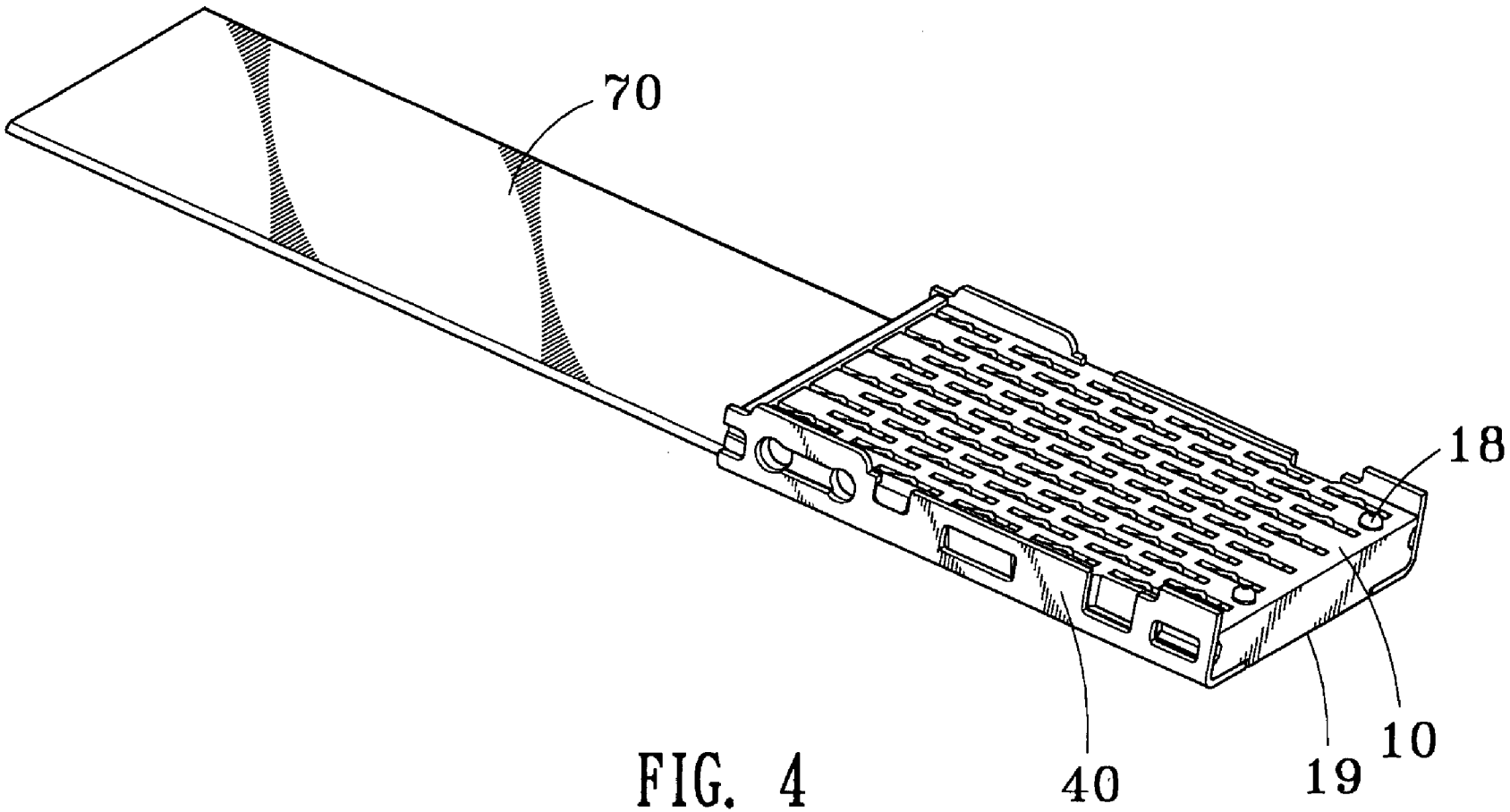
FIG. 4 is an assembled perspective view similar to FIG. 3 except for the second flexible printed circuit removed therefrom.
Figure 8:
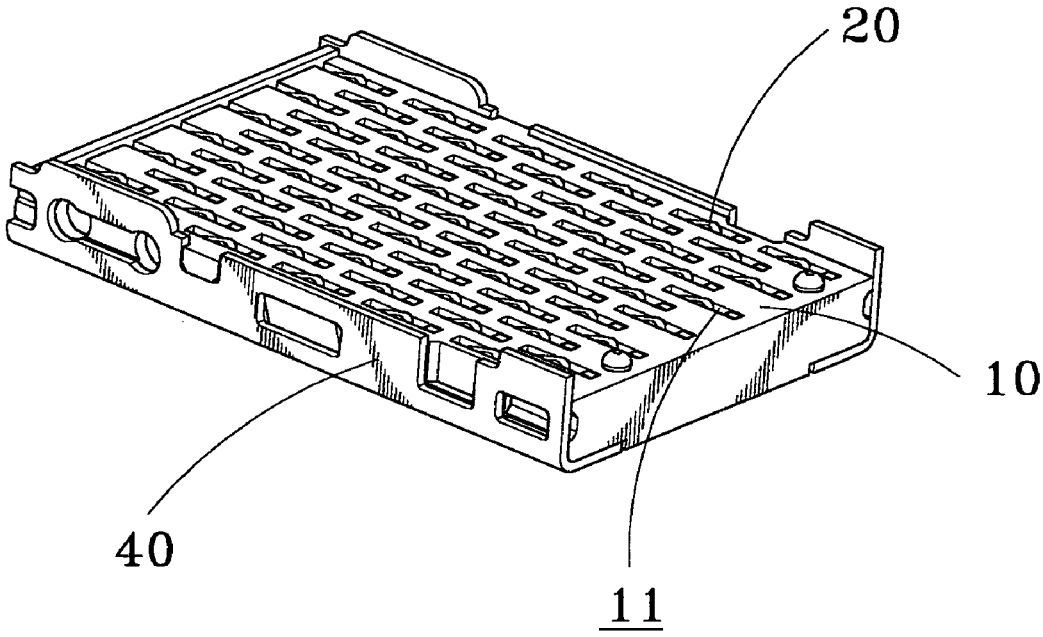
FIG. 8 is an assembled perspective view of the FPC connector with the top cover removed therefrom.
Figure 9:
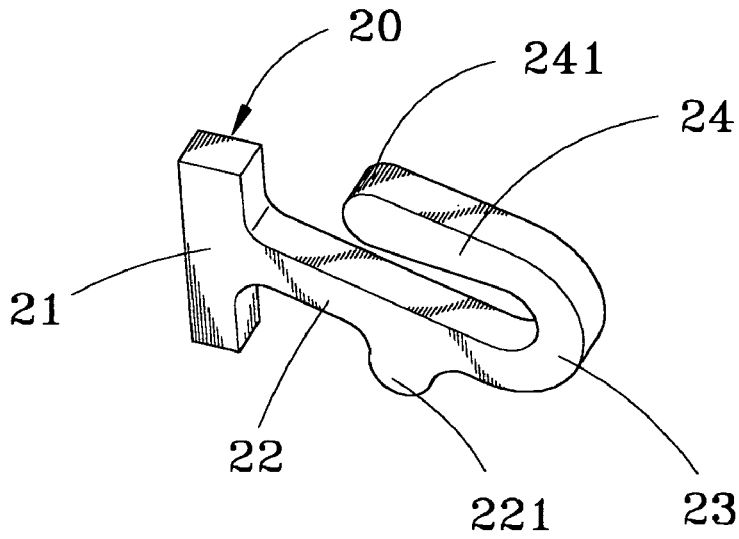
FIG. 9 is a perspective view of a contact for the FPC connector.

Referring to FIGS. 4 and 8 in conjunction with FIG. 1, the bottom cover 40 is mounted on the bottom side of the dielectric housing 10. Sidewalls 41 of the bottom cover 40 have a first and a second mating cutouts 42, 43 corresponding to the first engagement recesses 12 and the second engagement recess 13 of the housing 10, a second sliding groove 44 corresponding to the first sliding groove 14 of the housing 10, a back cutout 45 and a hole 46 corresponding to the upper protrusion 15 and the middle protrusion 16 of the housing 10. The upper protrusion 15 and the middle protrusion 16 are inserted into and engaged with the back cutout 45 and the hole 46 respectively, thereby securing the bottom cover 40 to the dielectric housing 10. The second sliding groove 44 is shaped and structured similar to the first sliding groove 14 including a first accommodating room 441 and a second accommodating room 442 at opposite ends thereof, and a middle channel 443 defined between and communicating with the first accommodating room 441 and the second accommodating room 442. The first mating cutout 42, the second mating cutout 43, the back cutout 45, the hole 46 and the second sliding groove 44 together constitute latch means of the bottom cover 40.

Figure 3:
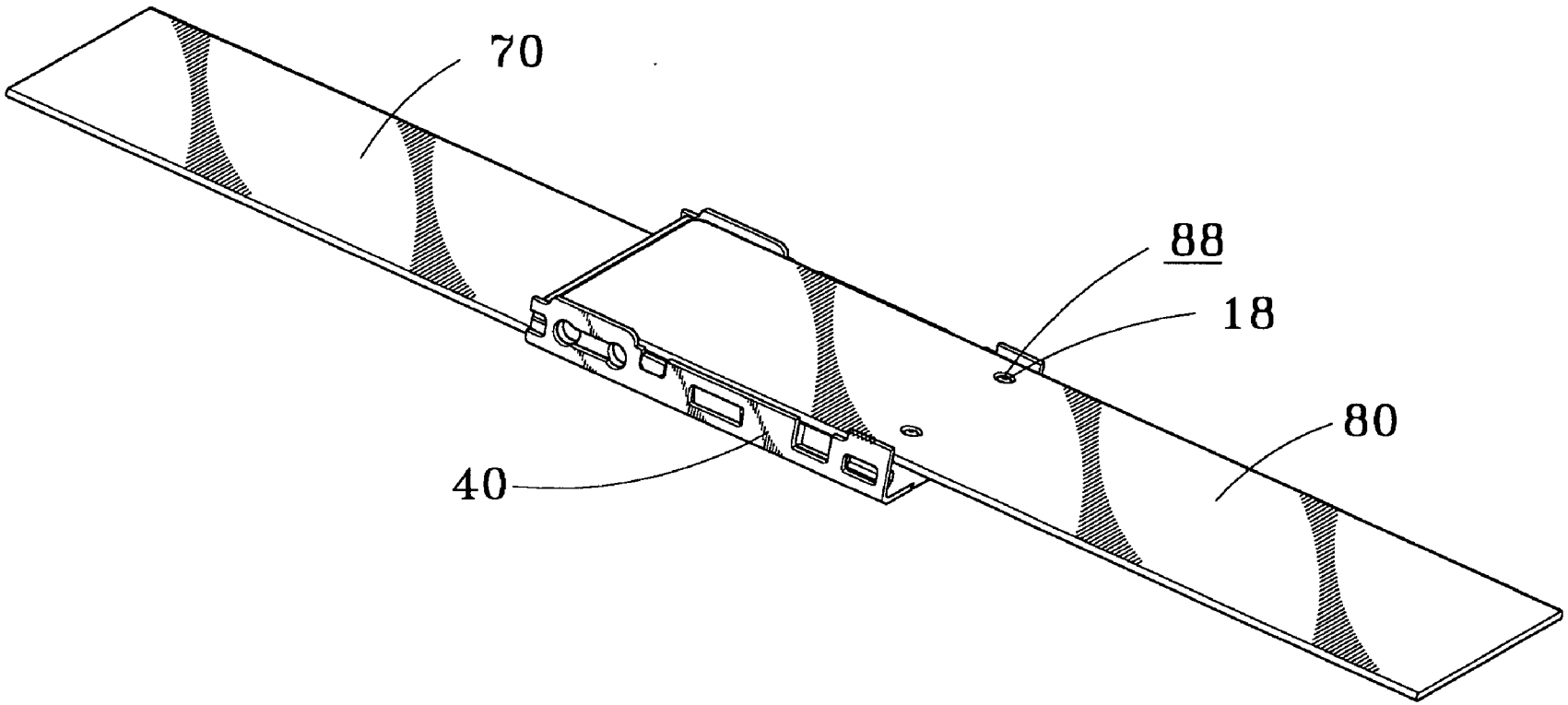
FIG. 3 is an assembled perspective view similar to FIG. 1 except for a top cover of the FPC connector removed therefrom.

Referring to FIGS. 3 and 4, a pair of posts 18 is formed on the top surface of the dielectric housing 10 extending upwardly into the second receiving space 60. The second flexible printed circuit 80 has a pair of positioning holes 88 corresponding to the posts 18. When the second flexible printed circuit 80 is inserted into the second receiving space 60, the posts 18 come into the positioning holes 88 to anchor the second flexible printed circuit 80, thereby reliably and precisely retaining the second flexible printed circuit 80 in the FPC connector 100.

Figure 5:
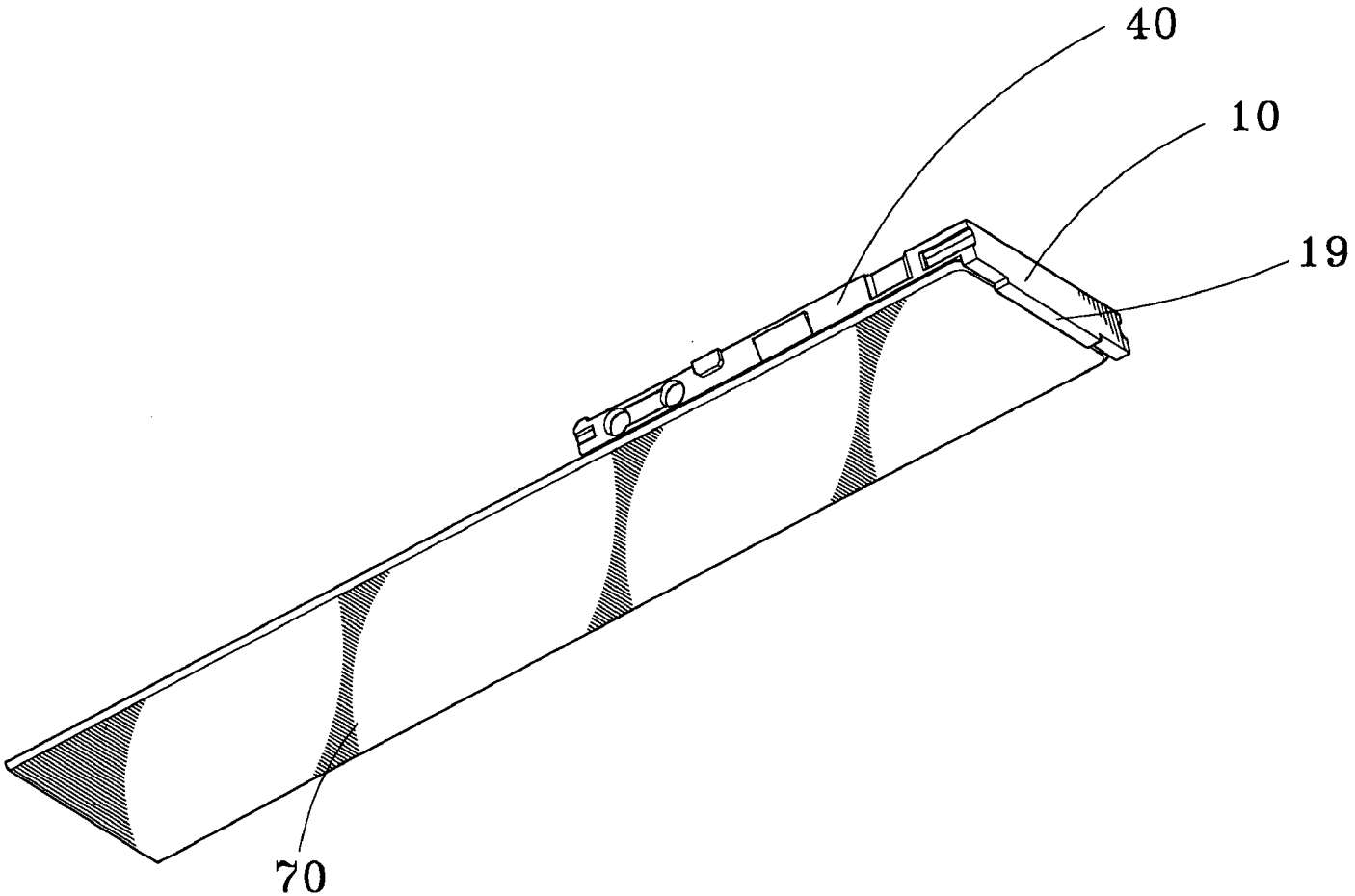
FIG. 5 is an assembled perspective view similar to FIG. 4 except for a bottom cover of the FPC connector removed therefrom.

Referring to FIG. 2 in conjunction with FIGS. 4, 5 and 7, A projection 19 is extended downwardly from the front of the dielectric housing 10. The bottom cover 40 provides an indentation 49 to accommodate the projection 19, thus the front end of the first receiving space 50 is at least partially enclosed. When the first flexible printed circuit 70 is inserted into the first receiving space 50, the front end of the first flexible printed circuit 70 is stopped by the projection 19 thereby positioning the first flexible printed circuit 70 in the FPC connector 100.

Please further refer to FIGS. 4, 5, 7 and 9. A plurality of electrical contacts 20 is received in the respective contact chambers 11. Each contact 20 comprises a base portion 21, a first support arm 22 extending substantially away from the middle part of the base portion 21, a connecting portion 23 curved upwardly from the first support arm 22, a second contact arm 24 extending horizontally from the connecting portion 23 back towards the base portion 21. The first support arm 22 has a first contact portion 221 projected downwardly and exposed in the first receiving space 50 to electrically connect the first flexible printed circuit 70. The second contact arm 24 has a second contact portion 241 projected upwardly and exposed in the second receiving space 60 to electrically connect the second flexible printed circuit 80. Each contact 20 is resilient as a whole because the first support arm 22, the connecting portion 23 and the second contact arm 24 are formed as a U-shaped entity. When the first flexible printed circuit 70 and the second flexible printed circuit 80 are assembled in the FPC connector 100, the first contact portion 221 of the first support arm 22 and the second contact portion 241 of the second contact arm 24 are tightly connected with the first flexible printed circuit 70 and the second flexible printed circuit 80 due to the pressure on the first flexible printed circuit 70 and the second flexible printed circuit 80 from the first support arm 22 and the second contact arm 24.

Figure 10:
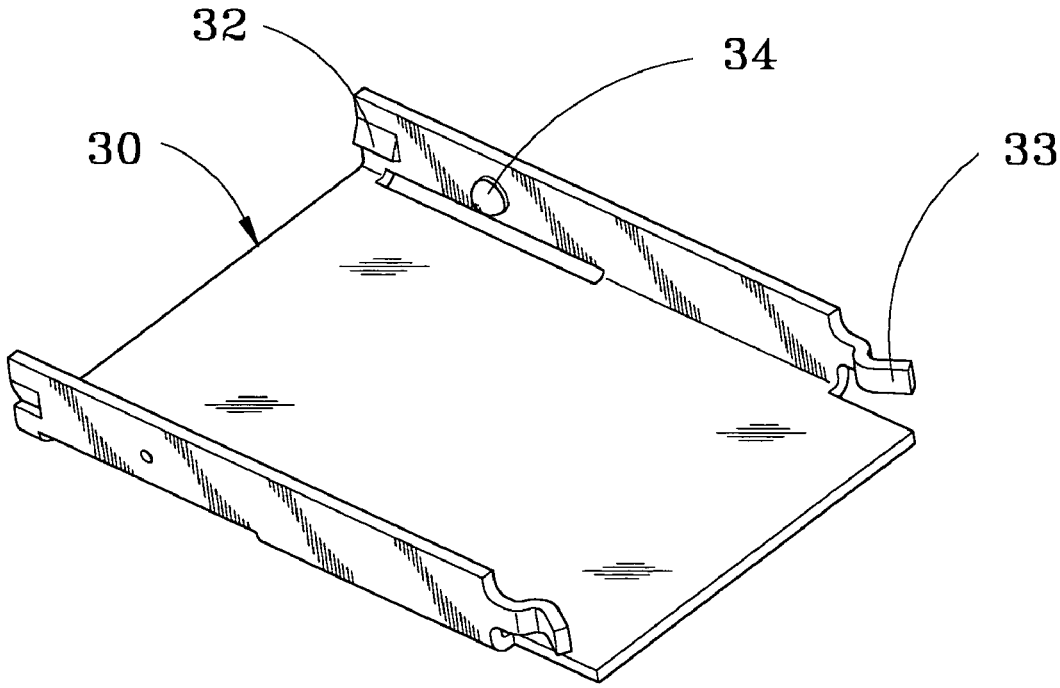
FIG. 10 is a perspective view of the top cover for the FPC connector.
Figure 11:
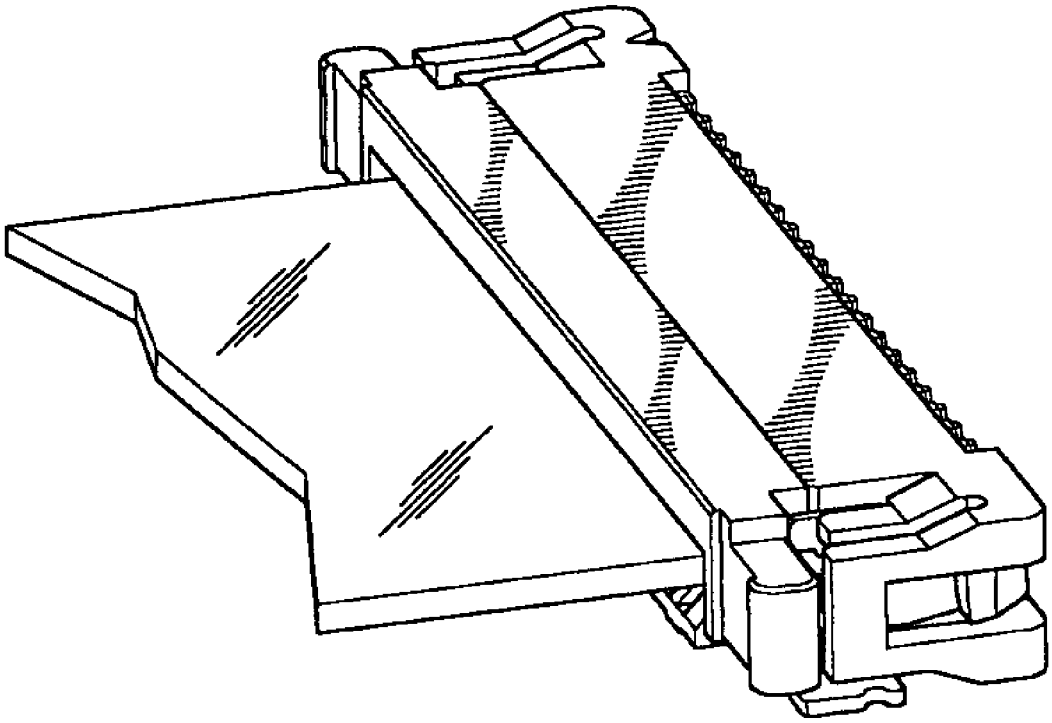
FIG. 11 is a perspective view of a traditional FPC connector.

Referring to FIGS. 2 and 10, recesses 17 are defined in the both side surfaces of the dielectric housing 10 adjacent the second engagement recess 13. Front cutouts 47 are set in the both sidewalls 41 of the bottom cover 40 corresponding to the recesses 17. The front cutouts 47 are exposed to the top surface of the dielectric housing 10, and the recesses 17 are open to the topside of the sidewalls 41. A pair of back mating parts 32 and a pair of front mating parts 33 are formed on the both sidewalls 31 of the top cover 30 at opposite ends thereof. The mating parts 32, 33 constitute latch means of the top cover. A pair of inner protrusions 34 is extended inwardly from the both sidewalls 31. The inner protrusions 34 are slidable in the first sliding groove 14 and the second sliding groove 44 and serve as pivots to enable the top cover 30 to pivot and slide relative to the dielectric housing 10. When to assemble the top cover 30 to the dielectric housing 10, the inner protrusion 34 are first put into the first accommodating rooms 441 and the first accommodating spaces 141 in which the inner protrusions 34 can rotate as latch means of the top cover 30 being in disengagement with that of the dielectric housing 10 and the bottom cover 40 to enable the top cover 30 to move to an open position. In the open position, the second flexible printed circuit 80 is inserted in the second receiving space 60 and positioned between the dielectric housing 10 and the top cover 30. Then pivoting the top cover 30 toward the dielectric housing 10 to a closed position, the second flexible printed circuit 80 is urged to electrically engage with the electrical contacts 20.

Finally, the top cover 30 is moved forward relative the dielectric housing 10 as sliding the inner protrusions 34 along the middle passage 143 and the middle channel 443 till the protrusions 34 are received in the second accommodating space 142 and the second accommodating room 442 wherein the back mating parts 32 and the front mating parts 33 of the top cover 30 are engaged with the first and the second engagement recesses 12, 13 of the housing 10 and the first and the second mating cutouts 42, 43 of the bottom cover 40. The top cover 30 is thus latched to the bottom cover 40 and the housing 10 in a closed and latched position. The front cutouts 47 and the recesses 17 in the present invention are provided for permitting the front mating parts 33 to pass therethrough when the top cover 30 is moved between the open position and the closed position.

It is to be understood, however, that even though numerous characteristics and advantages of the present invention have been set forth in the foregoing descriptions, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flexible printed circuit connector comprising:

a dielectric housing having a plurality of contact chambers extending through the dielectric housing;

a bottom cover mounted on a bottom side of the dielectric housing to define a first receiving space therebetween for receiving a first flexible printed circuit;

a top cover mounted on a top side of the dielectric housing to define a second receiving space therebetween for receiving a second flexible printed circuit; and a plurality of electrical contacts received in the respective contact chambers, each electrical contact having a pair of contact portions, one of which is exposed in the first receiving space to electrically connect the first flexible printed circuit, and the other of which is exposed in the second receiving space to electrically connect the second flexible printed circuit, wherein the housing has a projection extending downwardly from the front end thereof, and the bottom cover provides an indentation to accommodate the projection, thereby at least partially enclosing the front end of the first receiving space to stop and position the first flexible printed circuit.

2. The flexible printed circuit connector as claimed in claim 1, further comprising several posts formed on the top surface of the dielectric housing and extending upwardly into the second receiving space to anchor the second flexible printed circuit.

3. The flexible printed circuit connector as claimed in claim 1, wherein said contact includes a base portion, a first support arm extending away from the base portion, a curved connecting portion and a second contact arm extending back toward the base portion, and wherein said contact portions are formed on the first support arm and the second contact arm.

4. A flexible printed circuit connector comprising:

a dielectric housing having a plurality of contact chambers extending through the dielectric housing;

a bottom cover mounted on a bottom side of the dielectric housing to define a first receiving space therebetween for receiving a first flexible printed circuit;

a top cover mounted on a top side of the dielectric housing to define a second receiving space therebetween for receiving a second flexible printed circuit; and a plurality of electrical contacts received in the respective contact chambers, each electrical contact having a pair of contact portions, one of which is exposed in the first receiving space to electrically connect the first flexible printed circuit, and the other of which is exposed in the second receiving space to electrically connect the second flexible printed circuit, wherein the dielectric housing has an upper protrusion and a middle protrusion protruded outwardly from side surfaces thereof, and the bottom cover has a back cutout and a hole in sidewalls thereof for engaging with the upper protrusion and the middle protrusion to secure the bottom cover to the dielectric housing.

5. A flexible printed circuit connector comprising:

a dielectric housing having a plurality of contact chambers extending through the dielectric housing;

a bottom cover mounted on a bottom side of the dielectric housing to define a first receiving space therebetween for receiving a first flexible printed circuit;

a top cover mounted on a top side of the dielectric housing to define a second receiving space therebetween for receiving a second flexible printed circuit; and a plurality of electrical contacts received in the respective contact chambers, each electrical contact having a pair of contact portions, one of which is exposed in the first receiving space to electrically connect the first flexible printed circuit, and the other of which is exposed in the second receiving space to electrically connect the second flexible printed circuit, wherein the top cover has inner protrusions, the dielectric housing and the bottom cover have first and second sliding grooves in which the inner protrusions are disposed enabling the top cover to slide relative to the dielectric housing.

6. The flexible printed circuit connector as claimed in claim 5, wherein each first sliding groove includes a first and a second accommodating spaces at opposite ends thereof, and a middle passage extending between said first and second accommodating spaces, and each second sliding groove includes a first and a second accommodating rooms at opposite ends thereof, and a middle channel extending between said first and second accommodating rooms, when the inner protrusions are accommodated in the first accommodating spaces and rooms, the top cover is rotatable between a open position and a closed position.

7. A flexible printed circuit connector comprising:

a dielectric housing having a plurality of contact chambers extending through the dielectric housing;

a bottom cover mounted on a bottom side of the dielectric housing to define a first receiving space therebetween for receiving a first flexible printed circuit;

a top cover mounted on a top side of the dielectric housing to define a second receiving space therebetween for receiving a second flexible printed circuit; and a plurality of electrical contacts received in the respective contact chambers, each electrical contact having a pair of contact portions, one of which is exposed in the first receiving space to electrically connect the first flexible printed circuit, and the other of which is exposed in the second receiving space to electrically connect the second flexible printed circuit, wherein the dielectric housing has engagement recesses, the bottom cover has mating cutouts, and the top cover has mating parts engaging with the engagement recesses and the mating cutouts to latch the top cover to the dielectric housing and the bottom cover in a closed and latched position.

8. A flexible printed circuit connector comprising:

a dielectric housing having a plurality of electrical contacts secured therein and exposed on an upper side and a lower side thereof;

a bottom cover mounted on a bottom side of the dielectric housing to define a first receiving space therebetween to retain and electrically connect a first flexible printed circuit;

a top cover pivotally mounted on a top side of the dielectric housing for pivotal movement between an open position to enable a second flexible printed circuit to be positioned between the dielectric housing and the top cover and a closed position with the second flexible printed circuit in electrical engagement with the electrical contacts whereafter the top cover is slidable along the dielectric housing to a latched position; and latch means on the top cover, the bottom cover and the dielectric housing for latching the top cover in the closed and latched position.

9. The flexible printed circuit connector as claimed in claim 8, wherein the housing has a projection extending downwardly from the front end thereof, and the bottom cover provides an indentation to accommodate the projection, thereby at least partially enclosing the front end of the first receiving space to stop and position the first flexible printed circuit.

10. The flexible printed circuit connector as claimed in claim 8, further comprising several posts formed on the top surface of the dielectric housing and extending upwardly to anchor the second flexible printed circuit.

11. The flexible printed circuit connector as claimed in claim 8, wherein the dielectric housing has an upper protrusion and a middle protrusion protruded outwardly from side surfaces thereof, and the bottom cover has a back cutout and a hole in sidewalls thereof for engaging with the upper protrusion and the middle protrusion to secure the bottom cover to the dielectric housing.

12. The flexible printed circuit connector as claimed in claim 8, wherein said contact includes a base portion, a first support arm extending away from the base portion, a curved connecting portion and a second contact arm extending back toward the base portion, the first support arm and the second contact arm both has contact portions thereon to electrically contact with the first printed circuit and the second printed circuit respectively.

13. The flexible printed circuit connector as claimed in claim 8, wherein the dielectric housing has engagement recesses, the bottom cover has mating cutouts, and the top cover has mating parts engaging with the engagement recesses and the mating cutouts to latch the top cover to the dielectric housing and the bottom cover in the closed and latched position.

14. The flexible printed circuit connector as claimed in claim 13, wherein the top cover has inner protrusions, the dielectric housing and the bottom cover have first and second sliding grooves in which the inner protrusions are disposed, each first sliding groove includes a first and a second accommodating spaces and a middle passage, each second groove includes a first and a second accommodating rooms and a middle channel, the inner protrusions are rotatable in the first spaces and the first rooms and slidable between said first accommodating rooms and said second accommodating rooms to make said mating parts to engage or disengage with the engagement recesses and the mating cutouts.

* * * * *